US009533204B2

(12) United States Patent
McGuire et al.

(10) Patent No.: US 9,533,204 B2
(45) Date of Patent: Jan. 3, 2017

(54) GOLF BAGS WITH A STABILIZATION AND REINFORCEMENT SYSTEM AND METHODS TO MANUFACTURE GOLF BAGS WITH THE STABILIZATION AND REINFORCEMENT SYSTEM

(71) Applicant: Karsten Manufacturing Corporation, Phoenix, AZ (US)

(72) Inventors: Brian J. McGuire, Phoenix, AZ (US); John H. Loudenslager, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 269 days.

(21) Appl. No.: 14/053,342

(22) Filed: Oct. 14, 2013

(65) Prior Publication Data

US 2014/0034529 A1 Feb. 6, 2014

Related U.S. Application Data

(63) Continuation-in-part of application No. 13/197,649, filed on Aug. 3, 2011, now Pat. No. 8,910,785.

(51) Int. Cl.
*A63B 55/00* (2015.01)

(52) U.S. Cl.
CPC ..... *A63B 55/00* (2013.01); *A63B 55/53* (2015.10); *Y10T 16/525* (2015.01)

(58) Field of Classification Search
CPC ..... A63B 55/00; A63B 55/50; A63B 55/53; A63B 55/57; E05D 1/02; Y10T 16/52; Y10T 16/524; Y10T 16/525
See application file for complete search history.

(56) References Cited

U.S. PATENT DOCUMENTS

| | | | | |
|---|---|---|---|---|
| 400,895 | A | 4/1889 | Brown | |
| 527,975 | A | 10/1894 | Hart | |
| D42,259 | S | 3/1912 | McKinney | |
| 1,599,183 | A | 9/1926 | Phillips | |
| 1,769,011 | A | 7/1930 | Daniel | |
| 3,032,808 | A | 5/1962 | Fleming | |
| 3,525,493 | A | 8/1970 | Chrietzberg et al. | |
| 3,746,600 | A | 7/1973 | Circelli | |
| 3,787,922 | A | 1/1974 | Foy et al. | |
| 3,859,955 | A | 1/1975 | Labore | |
| 4,305,206 | A | 12/1981 | Roe | |
| 4,834,235 | A | 5/1989 | Solheim | |
| 5,340,063 | A | 8/1994 | Hsieh | |
| 5,351,921 | A | 10/1994 | Chen | |
| 5,381,920 | A * | 1/1995 | Lin | B25H 3/02 16/261 |

(Continued)

FOREIGN PATENT DOCUMENTS

| | | |
|---|---|---|
| CN | 102441261 | 5/2012 |
| DE | 10164152 | 7/2003 |
| GB | 2237188 | 7/1989 |

OTHER PUBLICATIONS

International Search Report and Written Opinion for International Application No. PCT/US2012/049476 dated Feb. 27, 2013.

*Primary Examiner* — Tri Mai

(57) ABSTRACT

Embodiments of golf bag having a stabilization and reinforcement system with a flexible one-piece hinge and methods to manufacture such a golf bag are generally described herein.

7 Claims, 18 Drawing Sheets

(56) References Cited

U.S. PATENT DOCUMENTS

| | | | | |
|---|---|---|---|---|
| 5,415,285 | A | 5/1995 | Reimers | |
| 5,539,955 | A * | 7/1996 | Wiese | E05D 1/02 16/225 |
| 5,597,144 | A | 1/1997 | Lee | |
| 5,762,189 | A | 6/1998 | Reimers | |
| 5,996,789 | A | 12/1999 | Suggs et al. | |
| 6,311,937 | B1 | 11/2001 | Han | |
| 6,435,345 | B1 | 8/2002 | Wang | |
| 6,474,606 | B1 | 11/2002 | Cheng | |
| 6,494,416 | B2 * | 12/2002 | Wang | A63B 55/53 248/166 |
| 7,017,869 | B2 | 3/2006 | Wang | |
| 7,427,204 | B1 | 9/2008 | Mangone | |
| 7,617,931 | B2 | 11/2009 | Shiao | |
| 7,870,954 | B2 | 1/2011 | Quartarone, III | |
| 2006/0108244 | A1 | 5/2006 | Tan | |
| 2007/0199176 | A1 * | 8/2007 | McClellan | E05D 1/02 16/224 |
| 2007/0246384 | A1 | 10/2007 | Shiao | |
| 2009/0308768 | A1 | 12/2009 | Quartarone | |
| 2011/0005949 | A1 | 1/2011 | Shiao | |
| 2012/0279883 | A1 * | 11/2012 | Lai | A63B 55/53 206/315.7 |
| 2013/0032499 | A1 | 2/2013 | Loudenslager | |

* cited by examiner

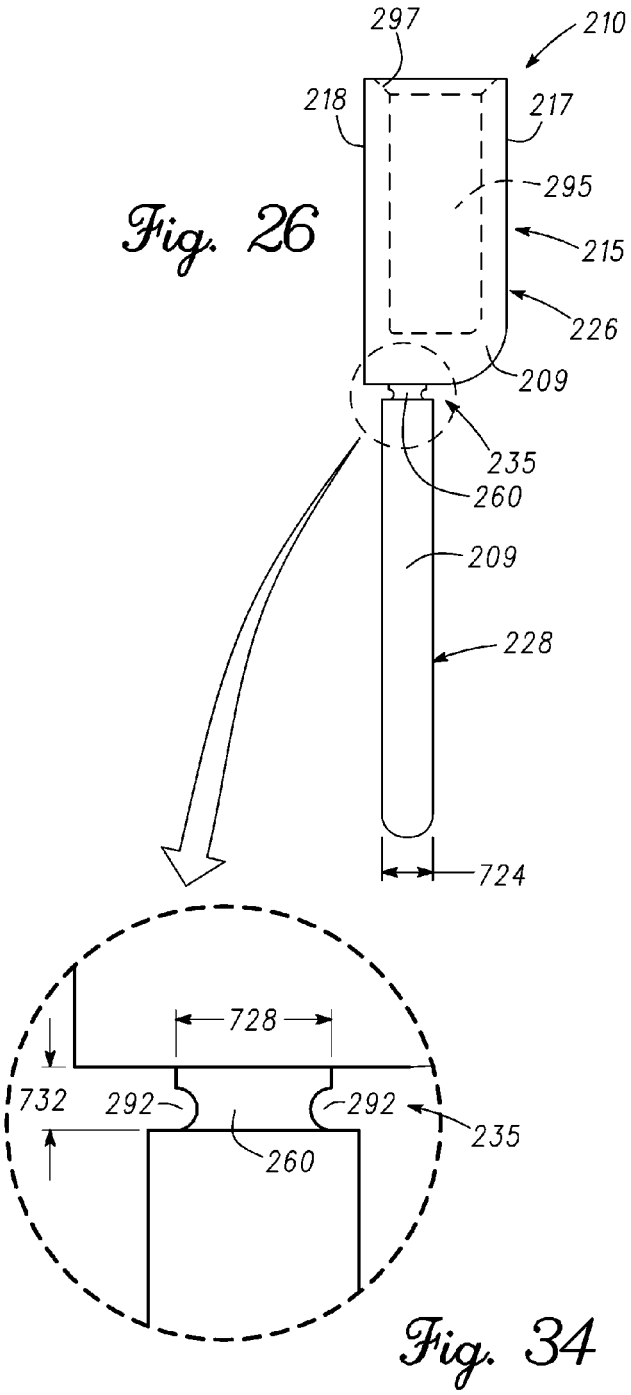
Fig. 26
Fig. 34
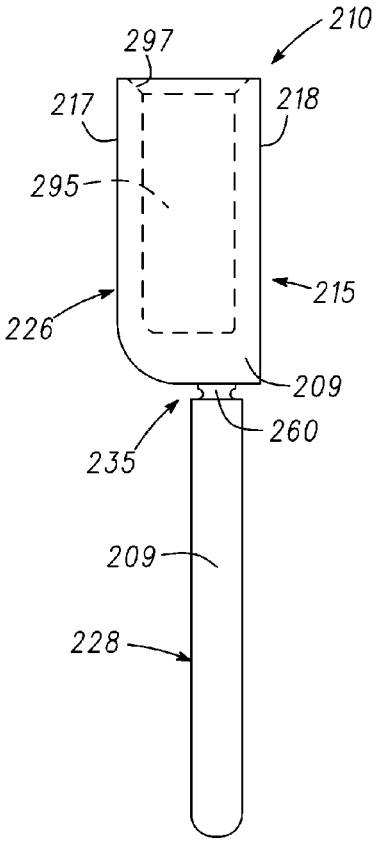
Fig. 27

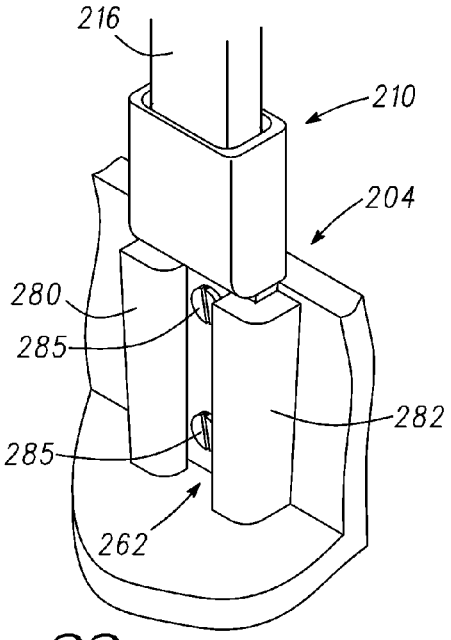
Fig. 32
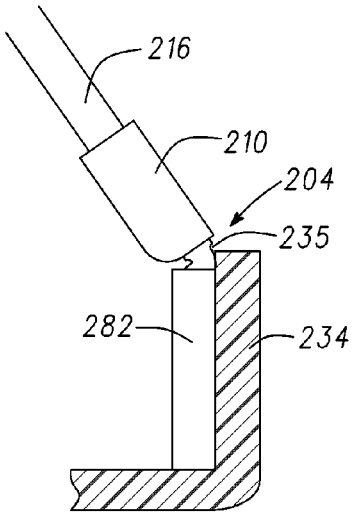
Fig. 33
Fig. 35
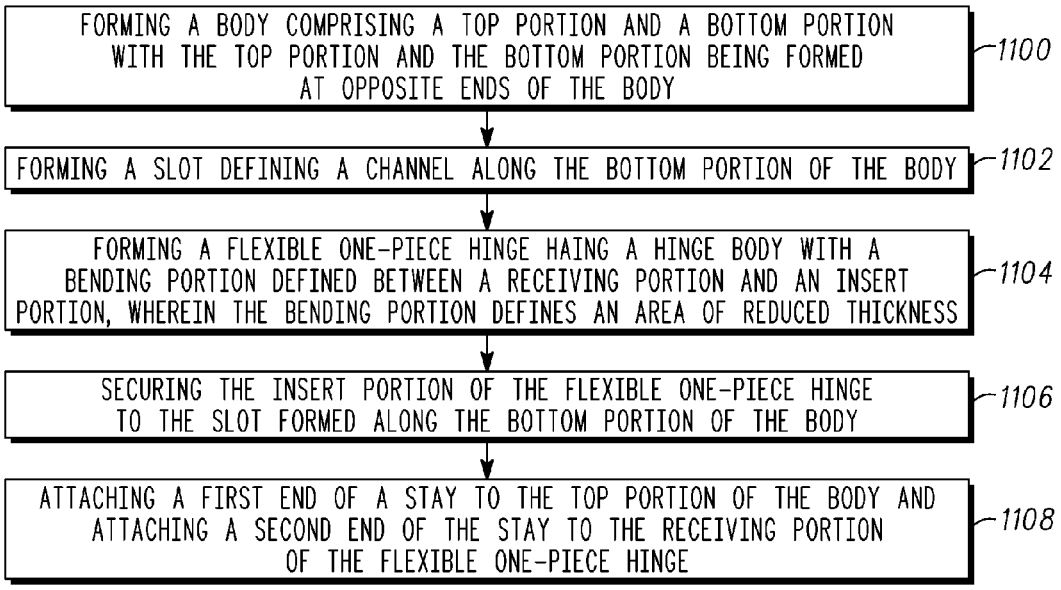

GOLF BAGS WITH A STABILIZATION AND REINFORCEMENT SYSTEM AND METHODS TO MANUFACTURE GOLF BAGS WITH THE STABILIZATION AND REINFORCEMENT SYSTEM

CROSS REFERENCE TO RELATED APPLICATIONS

This Continuation-In-Part Patent Application claims benefit to U.S. patent application Ser. No. 13/197,649, filed on Aug. 9, 2011, which is hereby incorporated by reference in its entirety.

FIELD

The present disclosure relates to golf bags with an extensible bag stand, and in particular to golf bags having an extensible bag stand with a stabilization and reinforcement system.

BACKGROUND

Most golf bags may be in the form of a tubular fabric or leather container having a generally cylindrical configuration with a closed bottom end and an open top end through which golf clubs are inserted into and removed from the golf bag. Although golf bags are manufactured in a variety of sizes and materials so as to better suit various intended uses, golf bags are conventionally grouped into two basic classes. The first class of golf bags are relatively larger and heavier golf bags designed to be carried by a pull cart or transported by a golf cart, while the second class of golf club bags are generally smaller and lighter golf bags designed to be carried by the individual during play.

The second class of golf bags are usually referred to as "carry bags" which are carried by the individual using a carrying strap that may be used to lift and carry the golf bag. Many of these types of carry bags have an extensible bag stand devised for supporting the golf bag in a substantially upright angular position whenever the individual sets down the golf bag on a surface. A widely used and well known extensible golf bag stand has been devised for demountable attachment to the side of golf bags and is disclosed in U.S. Pat. No. 4,834,235 which describes a golf bag stand having a pair of legs with one end pivotally attached to one portion of the golf bag and another end engaged to a retraction mechanism. The retraction mechanism is configured to operate with a toggle mechanism that causes the retraction mechanism to retract and collapse the pair of legs from a deployed position to a retracted position whenever the golf bag is lifted and carried by the individual. In addition, such carry bags having an extensible bag stand may include a stabilization system that allows the closed bottom end of the golf bag to remain substantially flat and along the same plane when the golf bag is placed from a substantially upright position when initially placed on a surface to a substantially upright angled position after the pair of legs of the extensible bag stand have been deployed. Known stabilization systems that allow the closed bottom end of the golf bag to remain on the same plane between the substantially upright position to the substantially upright angled position may include a bottom portion disposed adjacent or proximate to the closed bottom end of the golf bag and an top portion disposed adjacent or proximate to the open top end of the golf bag. The stabilization system further includes a flexible stay having a first end engaged to the top portion and a second end disposed within a pocket formed by the fabric of the golf bag adjacent or proximate to the bottom portion located along the closed bottom end of the golf bag. In addition, the stabilization system allows the closed bottom end of the golf bag to flex slightly when the golf bag is placed on a surface and the extensible bag stand is deployed such that the golf bag assumes a substantially upright angled position. However, the flexible stay can become loose or disengaged from the fabric pocket at times, which can require the individual to take the time to adjust or reinsert the flexible stay back into the fabric pocket.

BRIEF DESCRIPTION OF THE DRAWINGS

FIG. 26 is a side view of the flexible one-piece hinge of FIG. 22;

FIG. 27 is an opposing side view of the flexible one-piece hinge of FIG. 22;

FIG. 32 is an enlarged view showing the pivot of the flexible one-piece hinge when the extensible bag stand of FIG. 17 is placed from a substantially upright position to an angled position;

FIG. 33 is an enlarged view of the flexible one-piece hinge shown in FIG. 26;

FIG. 34 is an enlarged view of the bending portion of the flexible one-piece hinge shown in FIG. 26; and FIG. 35 is a flow chart illustrating a method for manufacturing the golf bag having the stabilization and reinforcement system of FIG. 17.

Corresponding reference characters indicate corresponding elements among the various views of the drawings. The headings used in the figures do not limit the scope of the claims.

Description

As described herein, golf bags having an extensible bag stand with a stabilization and reinforcement system, and methods of manufacturing such golf bags with the stabilization and reinforcement system are configured to provide stability and structural reinforcement as the golf bag is placed from a substantially upright position when initially placed on a surface to an angular position when the extensible bag stand is deployed. The stabilization and reinforcement system includes a stay having a first end engaged to a top portion located adjacent or proximate the open top end of the golf bag, and a second end engaged to a bottom portion located adjacent or proximate the closed bottom end of the golf bag. In some embodiments, the second end of the stay is engaged to a mechanical two-piece hinge secured to the bottom portion that establishes a secure connection with a pivot point that allows the stay to pivot while the bottom portion and the closed bottom end of the golf bag maintain a substantially parallel orientation relative to the surface. In some embodiments, the second end of the stay is engaged to a flexible one-piece hinge that also allows the stay to pivot while the bottom portion and the closed portion end of the golf bag maintain a substantially parallel orientation relative to the surface.

Figure 1:
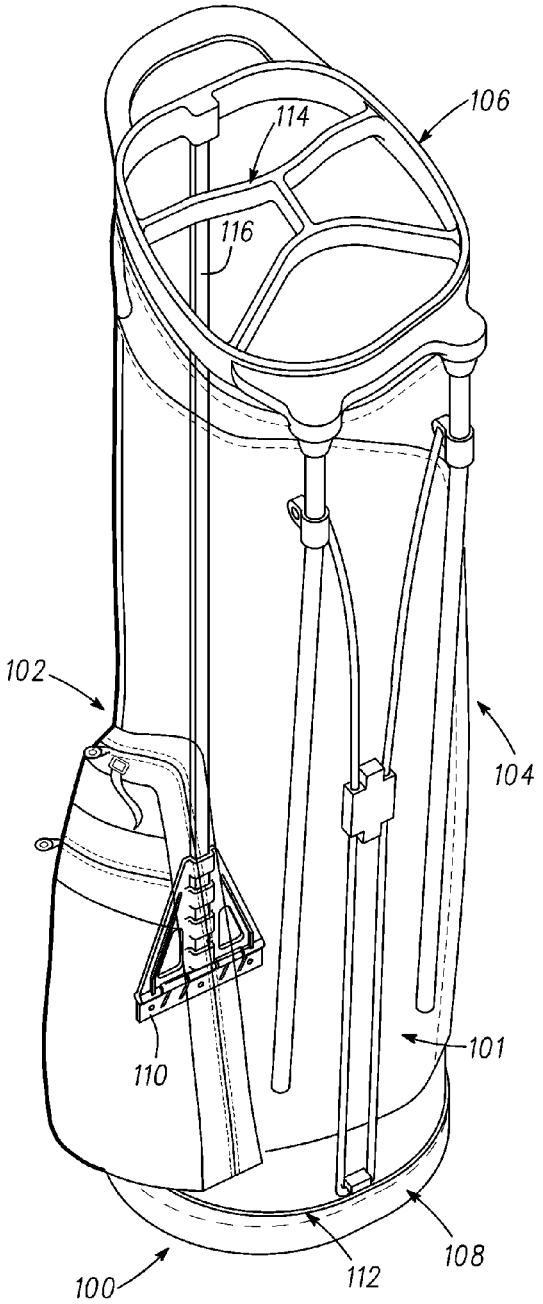
FIG. 1 is perspective view of a first embodiment of a golf bag having an extensible bag stand showing the stabilization and reinforcement system.
Figure 2:
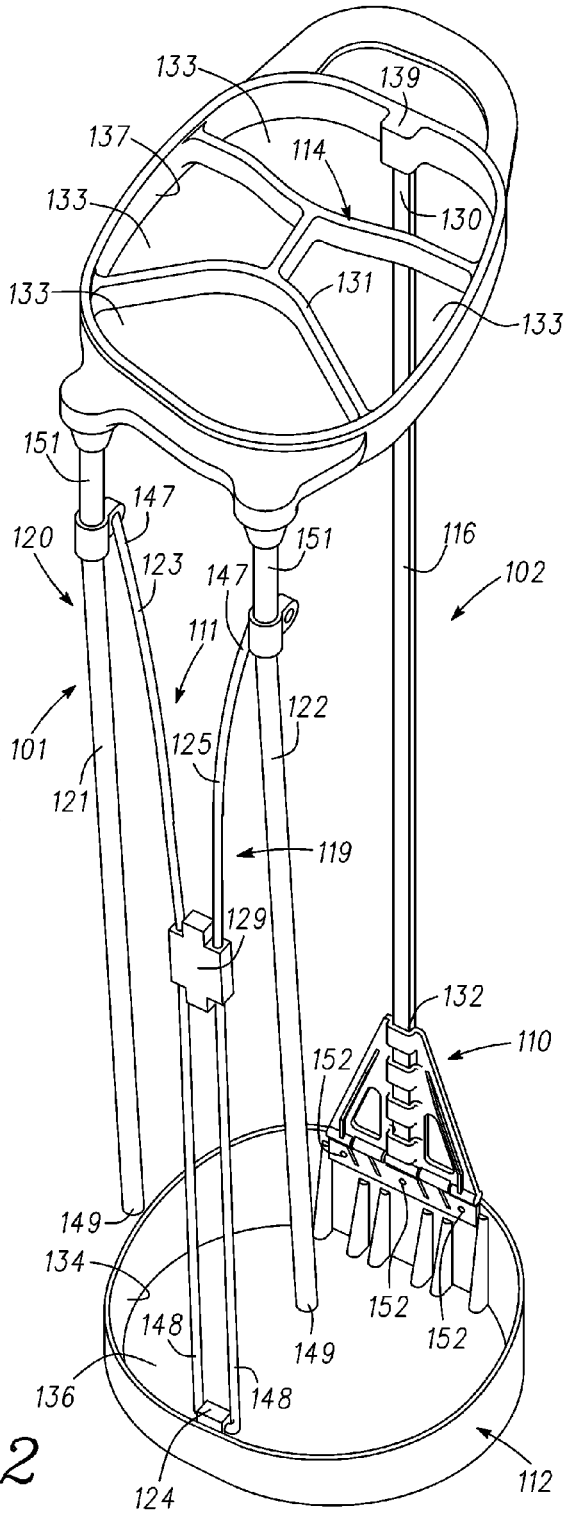
FIG. 2 is an elevated perspective view of the extensible bag stand with the stabilization and reinforcement system of FIG. 1.
Figure 3:
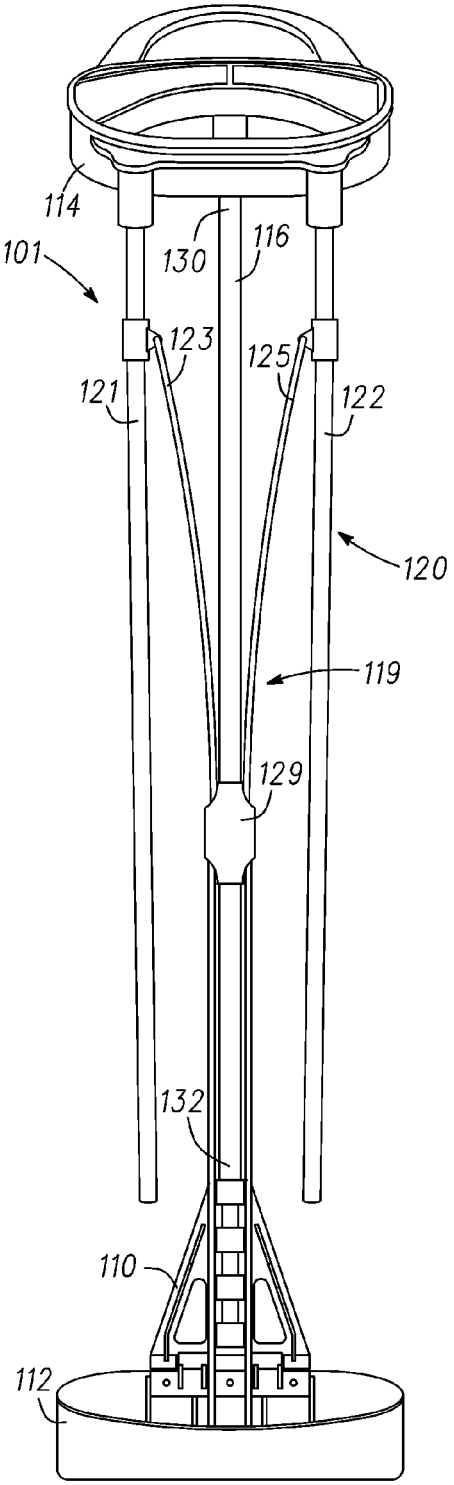
FIG. 3 is a front view of the extensible bag stand with the stabilization and reinforcement system of FIG. 1.
Figure 4:
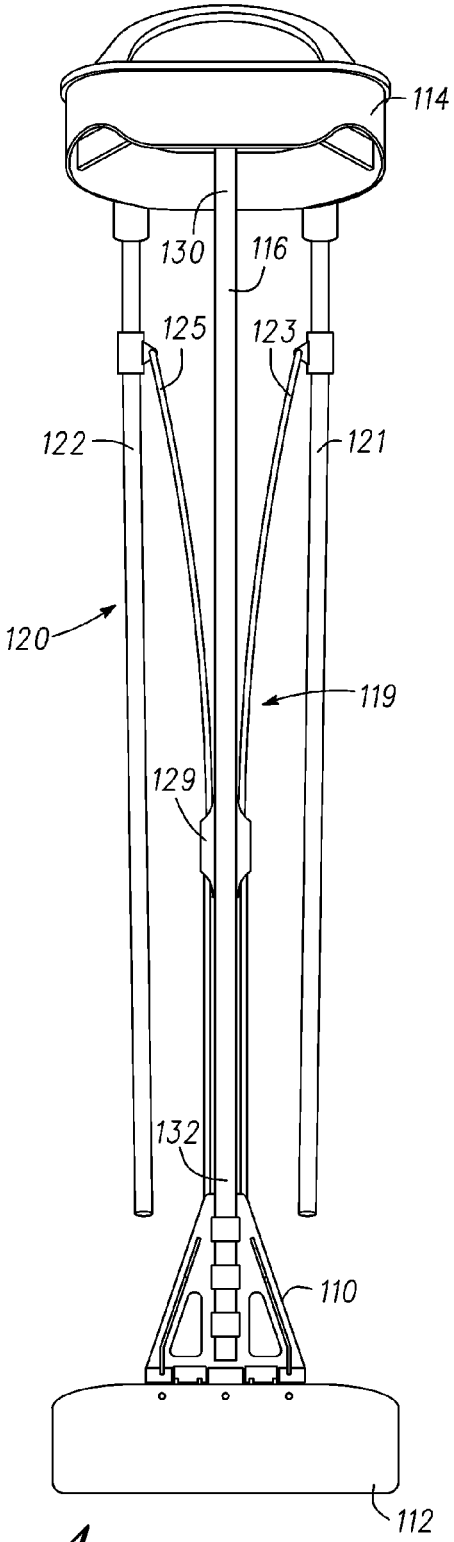
FIG. 4 is a rear view of the extensible bag stand with the stabilization and reinforcement system of FIG. 1.
Figure 5:
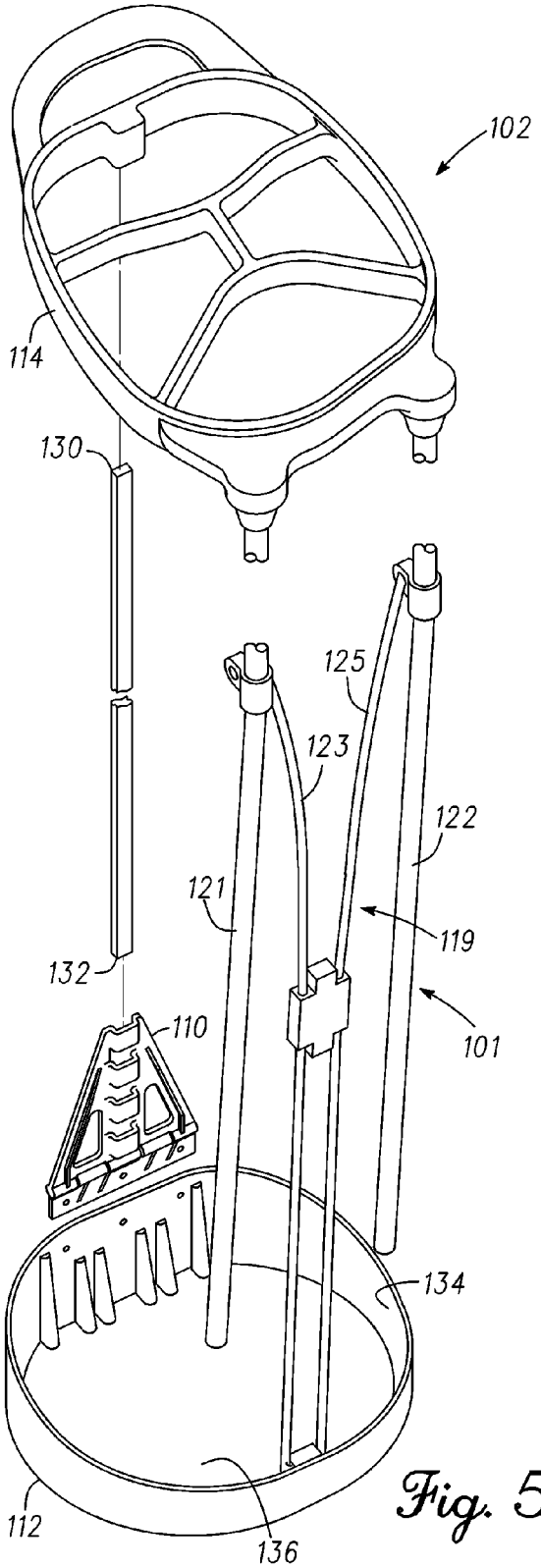
FIG. 5 is an exploded view of the extensible bag stand with the stabilization and reinforcement system of FIG. 1.

Referring to the drawings, embodiments of golf bags are illustrated and generally indicated as 100 and 200 in FIGS. 1-35. In a first embodiment shown in FIGS. 1-16, a golf bag, designated 100, includes a body 104 defining an open top end 106 and a closed bottom end 108. As shown, the body 104 includes an extensible bag stand 101 for supporting the body 104 in an angular position when an individual sets down the golf bag 100 on a surface 900 (FIGS. 11-14). Referring to FIG. 2, the extensible bag stand 101 includes a retraction mechanism 111 having an upper end 147 connected to a plurality of legs 120 and a lower end 148 connected to a toggle switch mechanism 124 for retracting the plurality of legs 120 when the extensible bag stand 101 is placed from the deployed position to the retracted position. In one embodiment, the plurality of legs may be a first leg 121 and a second leg 122.

As used herein the term "deployed position" shall mean the position of the plurality of legs 120 being substantially deployed outwardly from the body 104 when the individual sets the golf bag 100 down such that the plurality of legs 120 contact the surface 900, wherein the term "retracted position" shall mean the position of the plurality of legs 120 being substantially retracted inwardly towards the body 104 such that the plurality of legs 120 no longer contact the surface 900 as the individual lifts up the golf bag 100.

The retraction mechanism 111 for the extensible bag stand 101 may be a spring wire 119 made of a resilient metallic material that bias the plurality of legs 120 outwardly when the body 104 is placed in the deployed position and then retracts the plurality of legs 120 inwardly to the retracted position whenever the body 104 is lifted off surface 900. The spring wire 119 may be a single wire arrangement or a plurality of wires. Alternatively, the spring wire 119 may be made from any other resilient material, such as plastic or a metallic composite, capable of repeatedly applying a bias to the plurality of legs 120 in either the deployed position or the retracted position by the extensible bag stand 101.

As shown, one example of the spring wire 119 may be first and second wires 123 and 125 that engage the respective pair of legs 121 and 122. Specifically, the upper end 147 of the first and second wires 123 and 125 engage a respective leg 121 and 122, while the lower end 148 of the first and second wires 123 and 125 engage the toggle switch mechanism 124 that forms a part of the extensible bag stand 101 for causing either the deployed position or the retracted position of the plurality of legs 120 by the extensible bag stand 101. In some embodiments, the first and second wires 123 and 125 may be secured together through a coupler 129.

As further shown, the pair of legs 121 and 122 each define a first end 149 configured to support the body 104 in a substantially upright position on the surface 900 as well as a second end 151 that may be pivotally engaged to an top portion 114 attached proximate or adjacent to the open top end 106 of the golf bag 100. The pivotal engagement of each second end 151 to the top portion 114 may be a pin and socket arrangement which allows movement of the plurality of legs 120 along a two-dimensional plane or a ball and socket arrangement that allows movement of the plurality of legs 120 along a three-dimensional plane. In one embodiment, the structure and operation of the extensible bag stand 101 may be the extensible bag stand disclosed in U.S. Pat. No. 4,834,235, which is incorporated by reference in its entirety. However, the apparatus, articles of manufacture, and methods described herein are not limited in this regard.

Referring to FIGS. 2-5, in one embodiment the extensible bag stand 101 includes a stabilization and reinforcement system 102 that provides a means for reinforcing the structure of the golf bag 100 as well as stabilize the golf bag 100 when the golf bag 100 is placed from a substantially upright position when initially set on the surface 900 to an angular position when the extensible bag stand 101 places the golf bag 100 in the deployed position. As shown, the stabilization and reinforcement system 102 includes a bottom portion 112 engaged to the top portion 114 through a stay 116. The stay 116 defines a first end 130 configured to engage a receptacle 139 formed along a side portion 137 of the top portion 114 to secure the stay 116 therein and a second end 132 configured to engage a hinge 110 that is engaged to the bottom portion 112 for permitting the stay 116 to pivot when the golf bag 100 is placed in the deployed position. In some embodiments, the first end 130 of the stay 116 may be formed integral with the top portion 114. In some embodiments, the stay 116 may be elongated such that the stay 116 extends substantially the length of the body 104. In addition, the stay 116 may be made from a flexible material that permits the stay 116 to bend or flex under stress.

As shown in FIG. 2, the top portion 114 forms a divider 131 that is configured to form a plurality of openings 133 for permitting one or more golf clubs (not shown) to be inserted through the open top end 106 of the elongated tubular body 104. The bottom portion 112 includes a side portion 134 that surrounds a lower portion 136. In one arrangement, the toggle switch mechanism 124 is secured to one part of the side portion 134 and the hinge 110 is secured to an opposing part of the side portion 134 along the bottom portion 112.

Referring to FIGS. 6-10, the hinge 110 includes a hinge body 115 having a base portion 126 and a back portion 128 with a pivot portion 150 formed between the base and back portions 126 and 128 that permits the back portion 128 to pivot relative to the base portion 126. The hinge body 115 defines a front surface 117 and a rear surface 118. As further shown, the back portion 128 defines a generally triangular configuration forming a bottom side 153 and a top side 154 bounded by a first side 155 and an opposing second side 156, while the base portion 126 defines a generally rectangular configuration forming a bottom side 157 and a top side 158 bounded by a third side 159 and an opposing fourth side 160. Although the above example may describe and the figures may depict a particular shape for the back portion 128 of the hinge 110, the apparatus, systems, methods, and article of manufacture described herein may be include a back portion 128 of the hinge 110 may be other suitable shapes (e.g., rectangular configuration, lock-step configuration, U-shaped configuration, etc.).

Figure 6:
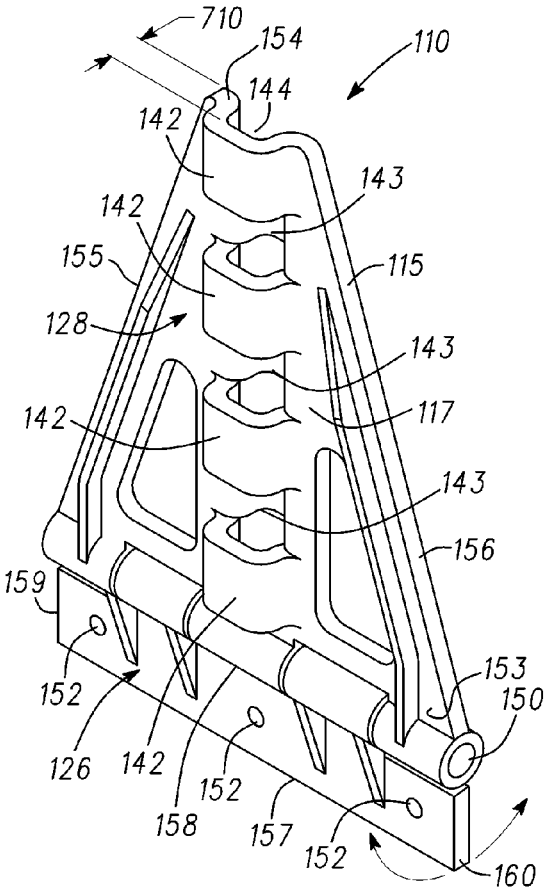
FIG. 6 is a perspective view of a hinge used in the stabilization and reinforcement system of FIG. 1.
Figure 7:
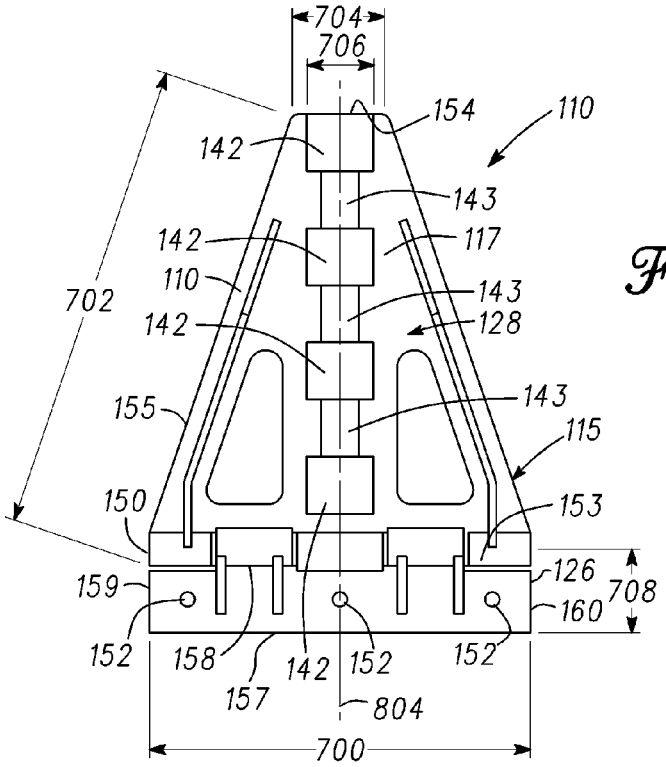
FIG. 7 is a front view of the hinge of FIG. 6.
Figure 8:
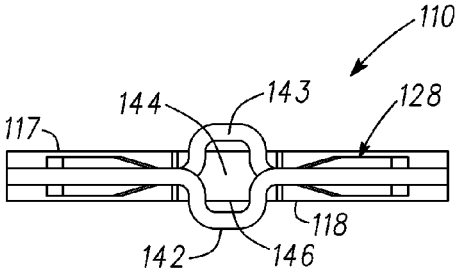
FIG. 8 is a top view of the hinge of FIG. 6.

Referring to FIGS. 6 and 7, the base portion 126 forms a plurality of openings 152 configured to receive a respective plurality of screws (not shown) that secure either the front surface 117 or rear surface 118 of the hinge body 115 to the bottom portion 112. In one embodiment shown in FIG. 2, the rear surface 118 of the hinge body 115 may be secured proximate or adjacent to a lip 145 formed along the edge of the side portion 134 defined by the bottom portion 112.

Figure 10:
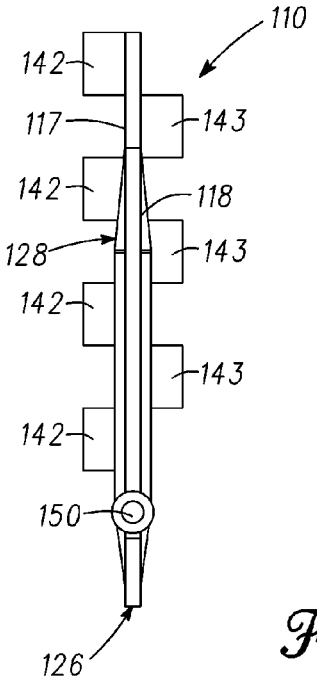
FIG. 10 is a side view of the hinge of FIG. 6.
Figure 9:
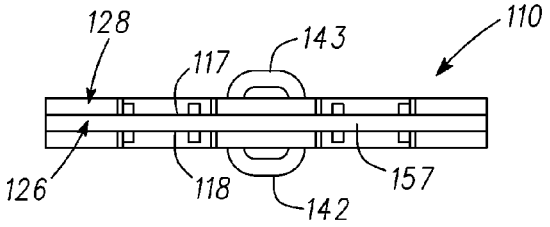
FIG. 9 is a bottom view of the hinge of FIG. 6.

As shown in FIGS. 6-10, the back portion 128 of the hinge 110 defines a center spine 144 that forms a plurality of first raised portions 142 in juxtaposition with a respective plurality of second raised portions 143. Referring to FIG. 10, the plurality of first raised portions 142 extends outwardly from the front surface 117 and the plurality of second raised portions 143 extends outwardly from the rear surface 118 in alternate opposing fashion relative to each other to collectively form a central channel 146 (FIG. 8) along a latitudinal axis 804 (FIG. 7) of the central spine 144. In one embodiment, the central channel 146 is configured to receive and secure the distal end 132 of the stay 116 therein.

Referring specifically to FIGS. 6 and 7, in one embodiment the back portion 128 of the hinge 110 may have dimensions in which the first and second sides 155 and 156 have a length 702 of 4.5 inches, the top side 154 has a length 704 of 1 inch, and the bottom side 153 has a length 700 of 4 inches, the top side 154 has a thickness 710 of 0.25 inches, and the center spine 144 formed by the back portion 128 has an inner diameter 706 of 0.5 inches. In one embodiment, the base portion 126 may have dimensions in which the third side 159 has a length 708 of 0.875 inches and fourth side 160 has the same length 708 of 0.875 inches. In some embodiments, length 700 may be between 2 inches and 6 inches, length 702 may be between 2 inches and 7 inches, the length 704 may be between 0.5 inches and 1.5 inches, the inner diameter 706 may be between 0.25 inches and 1 inches, the length 708 is between 2.5 inches and 0.5 inches, and the thickness 710 may be between 0.125 inches and 1 inches. Though particular dimensions for the invention are listed above, the dimensions are not limited in this regard.

While the above examples may describe and the figures may depict the apparatus, systems, methods, and articles of manufacture with multiple components as separate parts, two or more of these components may be a single integral part. In one example, the hinge 110 and the bottom portion 114 may be a single integral part. In another example, the hinge 110 and the stay 116 may be a single integral part. In yet another example, the top portion 112 and the stay 116 may be a single integral part. The apparatus, systems, methods, and articles of manufacture described herein are not limited in this regard.

Figure 11:
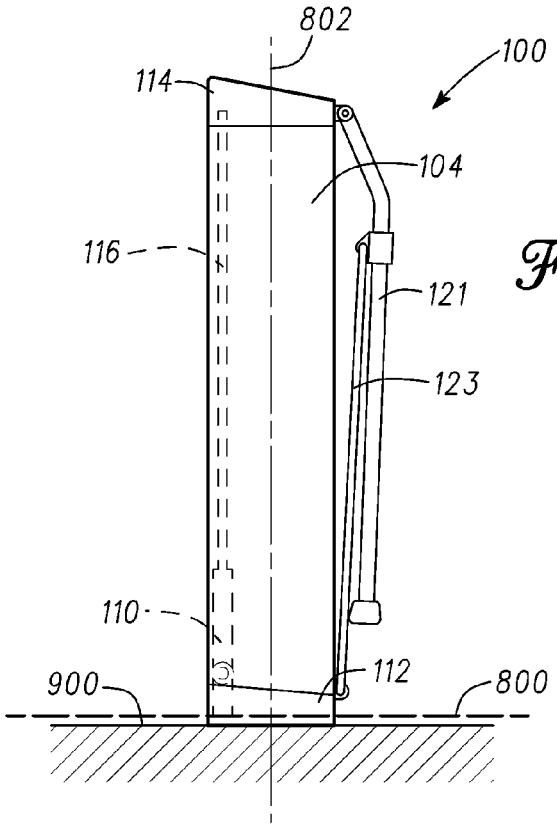
FIG. 11 is an illustration showing the golf bag with the extensible bag stand of FIG. 1 in a substantially upright position.
Figure 12:
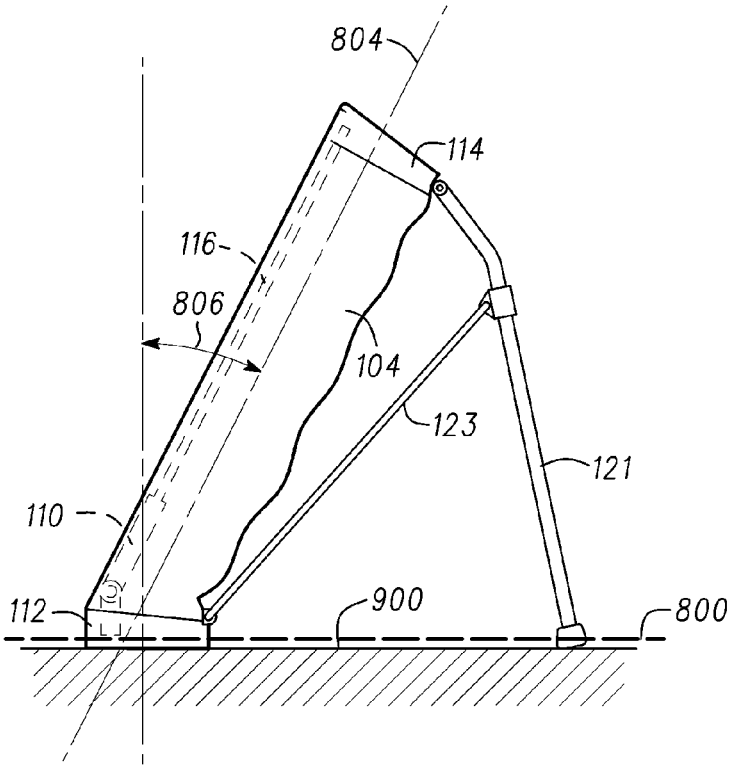
FIG. 12 is an illustration showing the golf bag with the extensible bag stand of FIG. 1 in an angled position.

Referring to FIGS. 11 and 12, the golf bag 100 is shown in a substantially upright position (FIG. 11) with the extensible bag stand 101 in the retracted position and in a substantially angular upright position (FIG. 12) with the extensible bag stand 101 in the deployed position. As shown in FIG. 11, when the golf bag 100 is set on the surface 900 in the substantially upright position the upper and bottom portions 112 and 114 of the stabilization and reinforcement system 102 are substantially aligned in parallel with longitudinal axis 800 and the stay 116 is substantially aligned in parallel with latitudinal axis 802. When the extensible bag stand 101 is in the deployed position as shown in FIG. 12, the top portion 114 and stay 116 is aligned along center axis 804, which is offset by a range of motion 806 from the latitudinal axis 802, while the bottom portion 112 remains substantially aligned in parallel along longitudinal axis 800 due to the swiveling operation of the hinge 110 in which the back portion 128 rotates relative to the stationary base portion 126 along the pivot portion 150.

Figure 13:
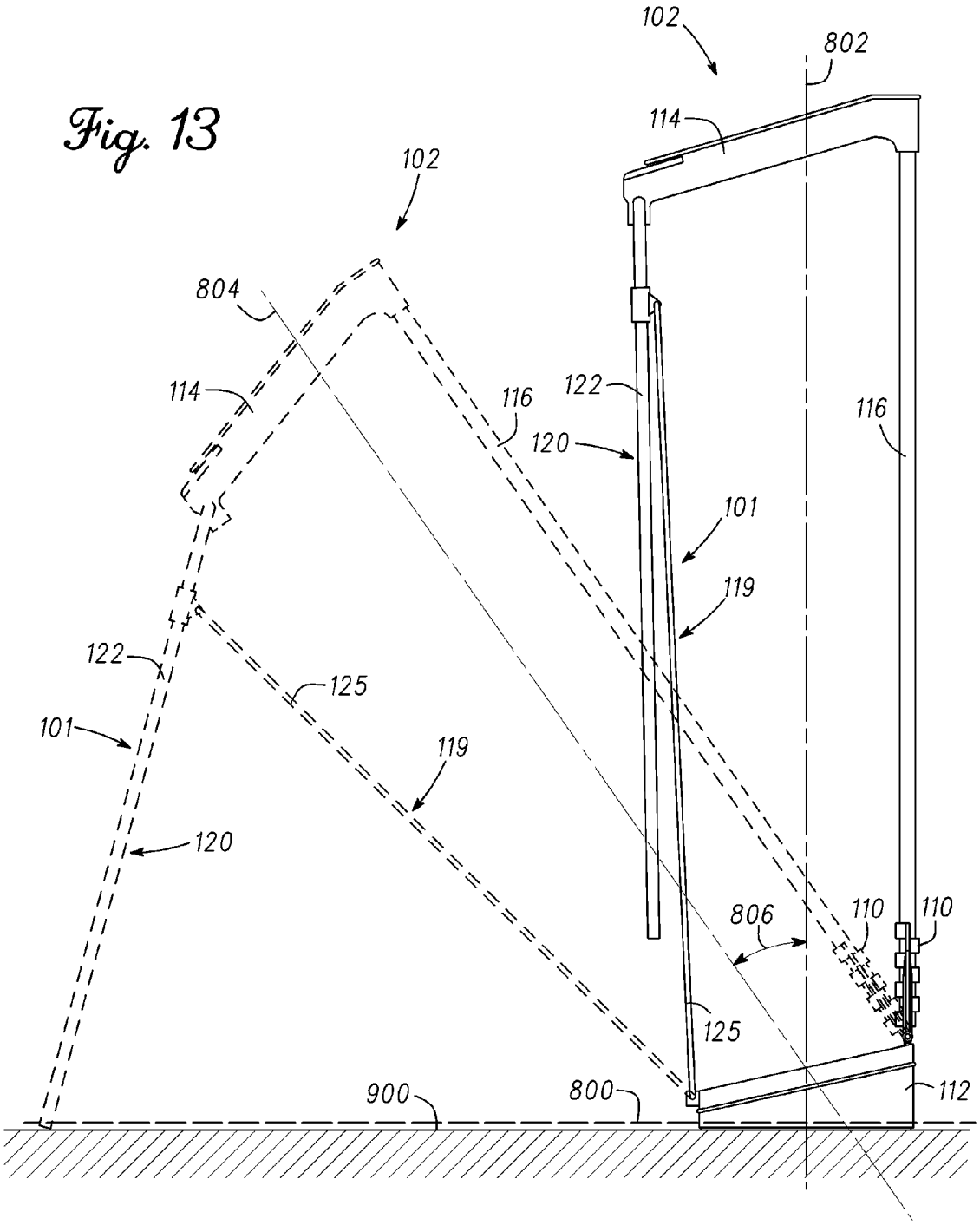
FIG. 13 is a side view showing a sequence of the extensible bag stand of FIG. 1 in a substantially upright position to an angled position in phantom.
Figure 14:
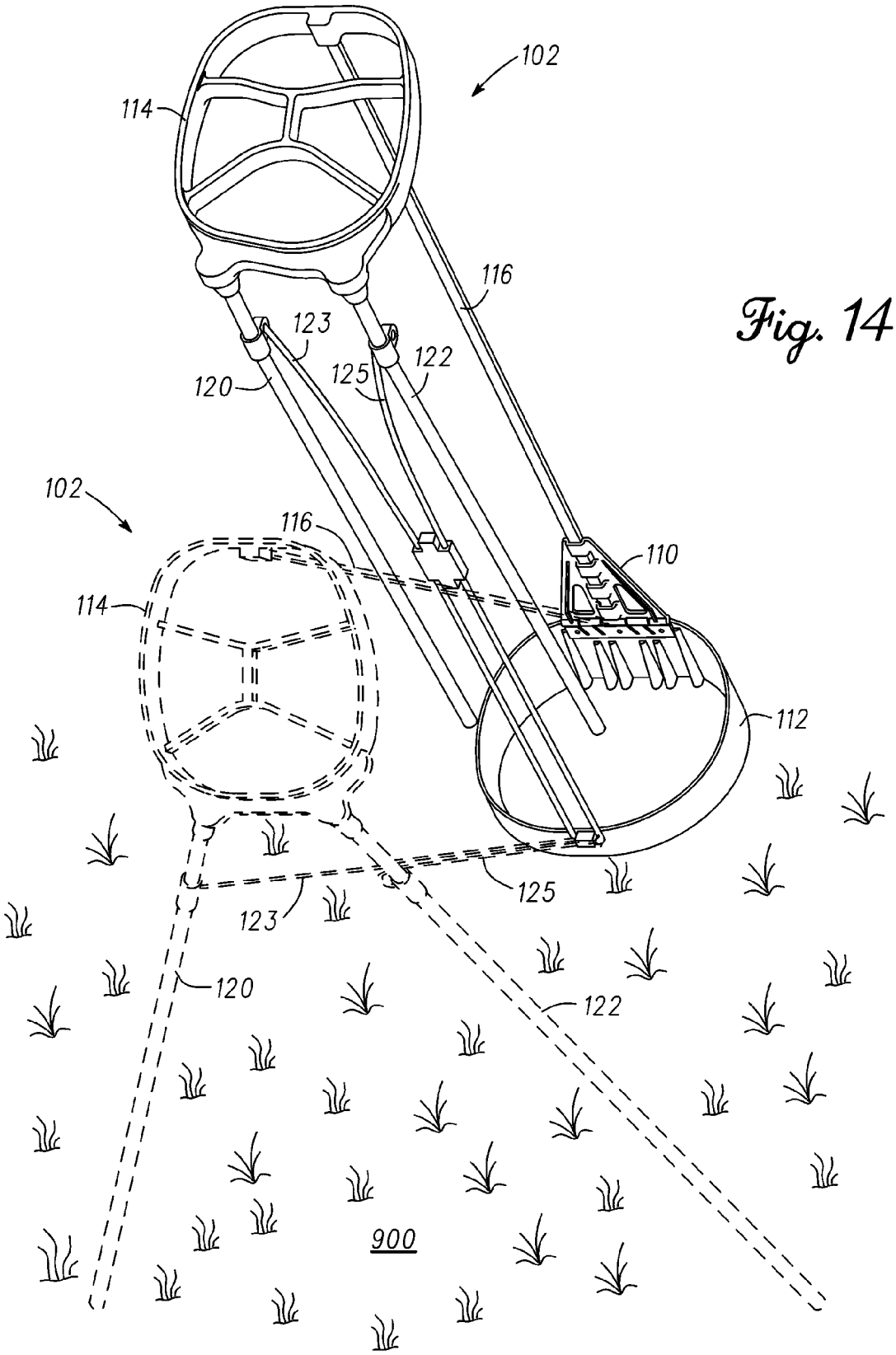
FIG. 14 is a perspective view showing the sequence of the extensible bag stand shown in FIG. 13.
Figure 15:
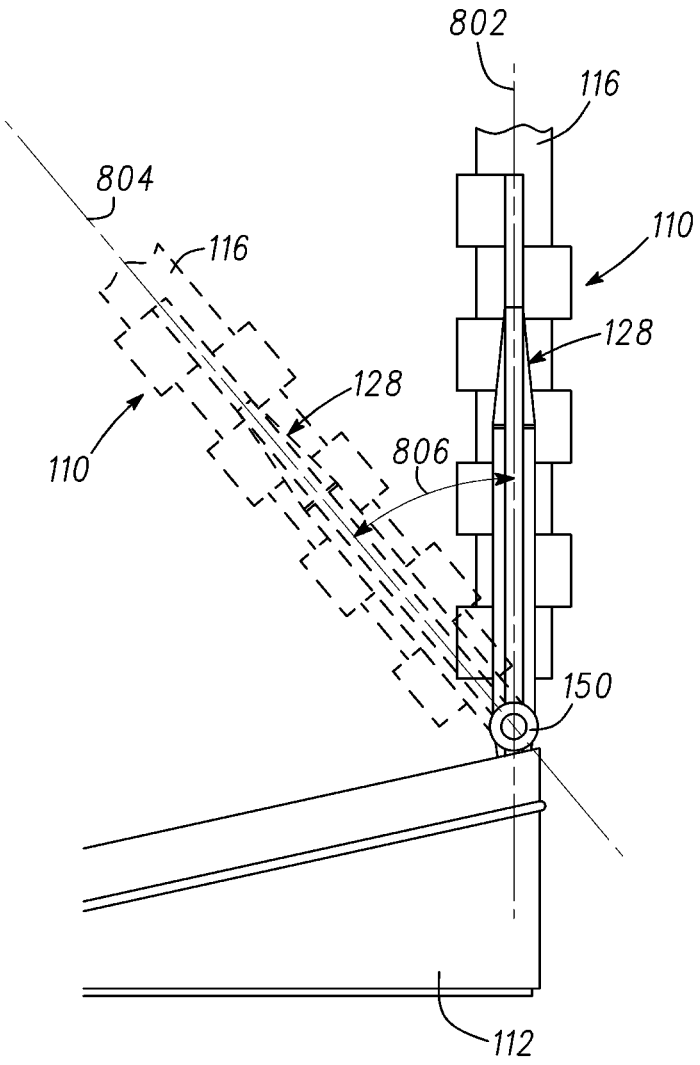
FIG. 15 is an enlarged view showing the pivoting action of the hinge when the extensible bag stand of FIG. 1 is placed from a substantially upright position to an angled position.

Referring to FIGS. 13 and 14, the stabilization and reinforcement system 102 is illustrated when the extensible bag stand 102 is in the retracted position and in the deployed position (shown in phantom). As noted above, when the extensible bag stand 101 is in the retracted position the stay 116 is substantially parallel with the latitudinal axis 802 and substantially perpendicular with the longitudinal axis 800, while the extensible bag stand 101 is in the deployed position the stay 116 is substantially parallel with the center axis 804, which forms a range of motion 806 relative to the latitudinal axis 802. For example, the range of motion 806 may be between 45 degrees to 90 degrees. In addition, the bottom portion 112 remains substantially parallel with the longitudinal axis 800 regardless of whether the extensible bag stand 101 is in the retracted or deployed position since the pivot portion 150 of the hinge 110 allows the back portion 128 to pivot relative to the stationary base portion 126 as illustrated in FIG. 15. As such, the arrangement of the stay 116 having the first end 130 secured to the top portion 114 and the second end 132 engaged to the hinge 110 stabilizes the golf bag 100 when the extensible bag stand 101 is in the deployed position, while also providing a frame that structurally reinforces the golf bag 100. The pivot portion 150 may be any structural arrangement that permits the back portion 128 to pivot relative to the base portion 126.

Figure 16:
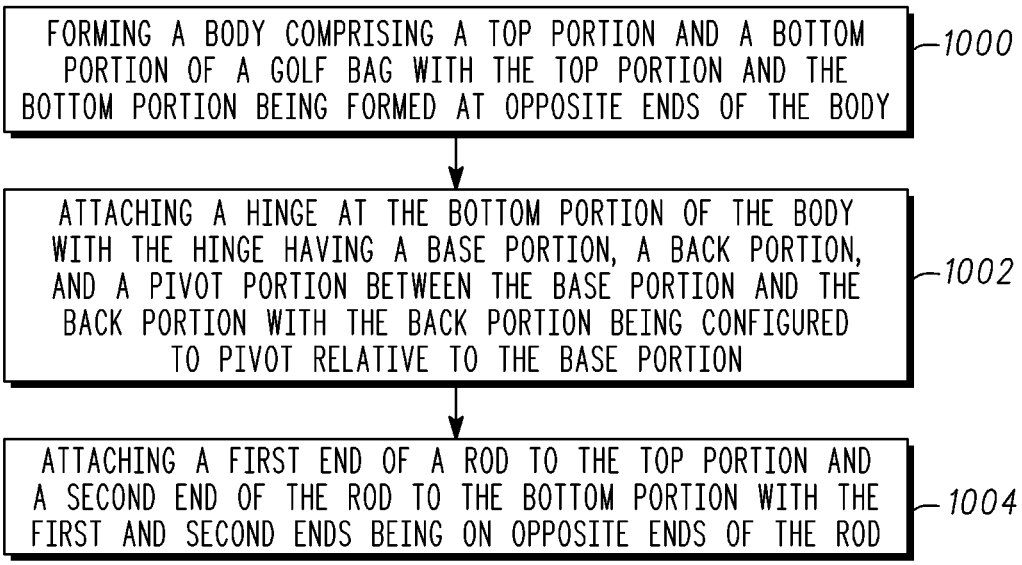
FIG. 16 is a flow chart illustrating a method for manufacturing a golf bag with the extensible bag stand having the stabilization and reinforcement system of FIG. 1.

Referring to FIG. 16, a flow chart is shown illustrating a method for manufacturing the golf bag 100 having the extensible bag stand 101 with the stabilization and reinforcement system 102. At block 1000, forming a body 104 comprising a top portion 114 and a bottom portion 112 with the top portion 114 and bottom portion 112 being formed at opposite ends of the body 104. At block 1002, attaching a hinge 110 to the bottom portion 112 of the body 104 with the hinge 110 having a base portion 126, a back portion 128, and a pivot portion 150 between the base portion 126 and the back portion 128 with the back portion 128 being configured to pivot relative to the base portion 126. At block 1004, attaching a first end 130 of a stay 116 to the top portion 114 and a second end 132 of the stay 116 to the bottom portion 112 with the first and second ends 130 and 132 being on opposite ends of the stay 116. In some embodiments, one or more first raised portions 142 and one or more second raised portions 143 may be formed on the back portion 128 of the hinge 110 to form a channel 146 to receive a portion proximate to the first end 130 of the stay 116. In some embodiments, at least one of the one or more first raised portions 142 may be formed in opposing juxtaposition relative to at least one or more second raised portions 143 to form the channel 146. In addition, the back portion 128 and base portion 126 of the hinge 110 may be configured to form an angle of about 180 degrees when the golf bag 100 is in a substantially upright position and an angle less than 180 degrees when the golf bag is in an angled position.

While a particular order of actions is illustrated in FIG. 16, these actions may be performed in other temporal sequences. For example, two or more actions depicted in FIG. 16 may be performed sequentially, concurrently, or simultaneously. Alternatively, two or more action depicted may be performed in reverse order. Further one or more actions in FIG. 16 may not be performed at all. The apparatus, methods, and articles of manufacture described herein are not limited in this regard.

Figure 17:
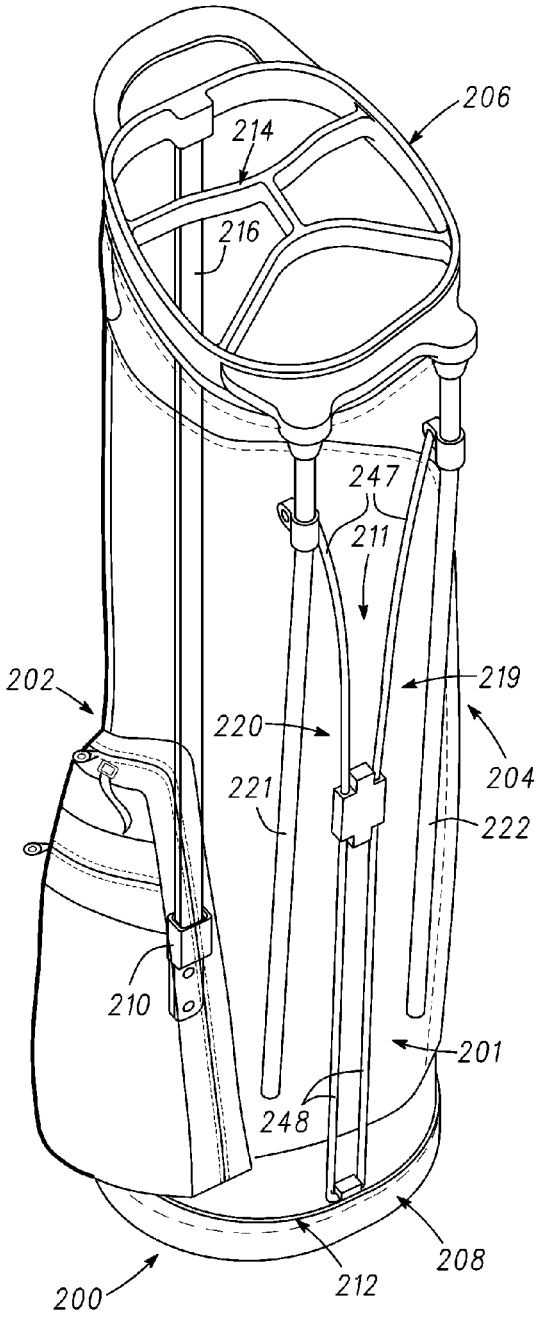
FIG. 17 is a perspective view of a second embodiment of a golf bag having an extensible bag stand showing another stabilization and reinforcement system.
Figure 18:
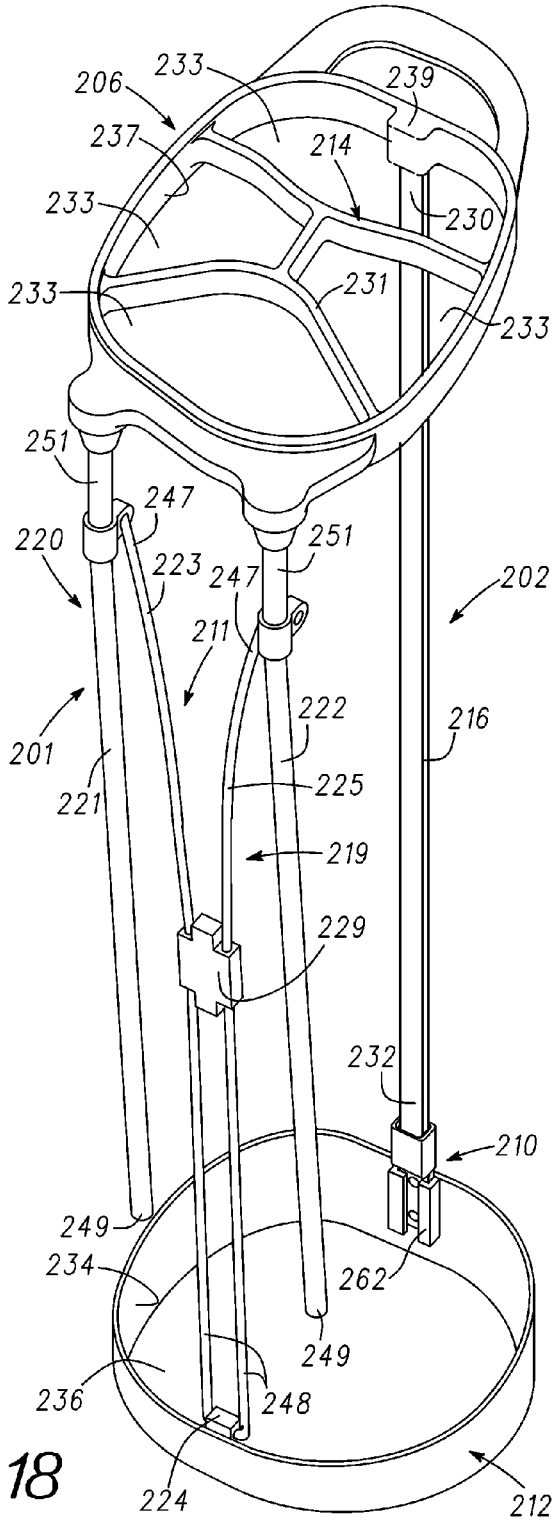
FIG. 18 is an elevated perspective view of the extensible bag stand with the stabilization and reinforcement system of FIG. 17.
Figure 28:
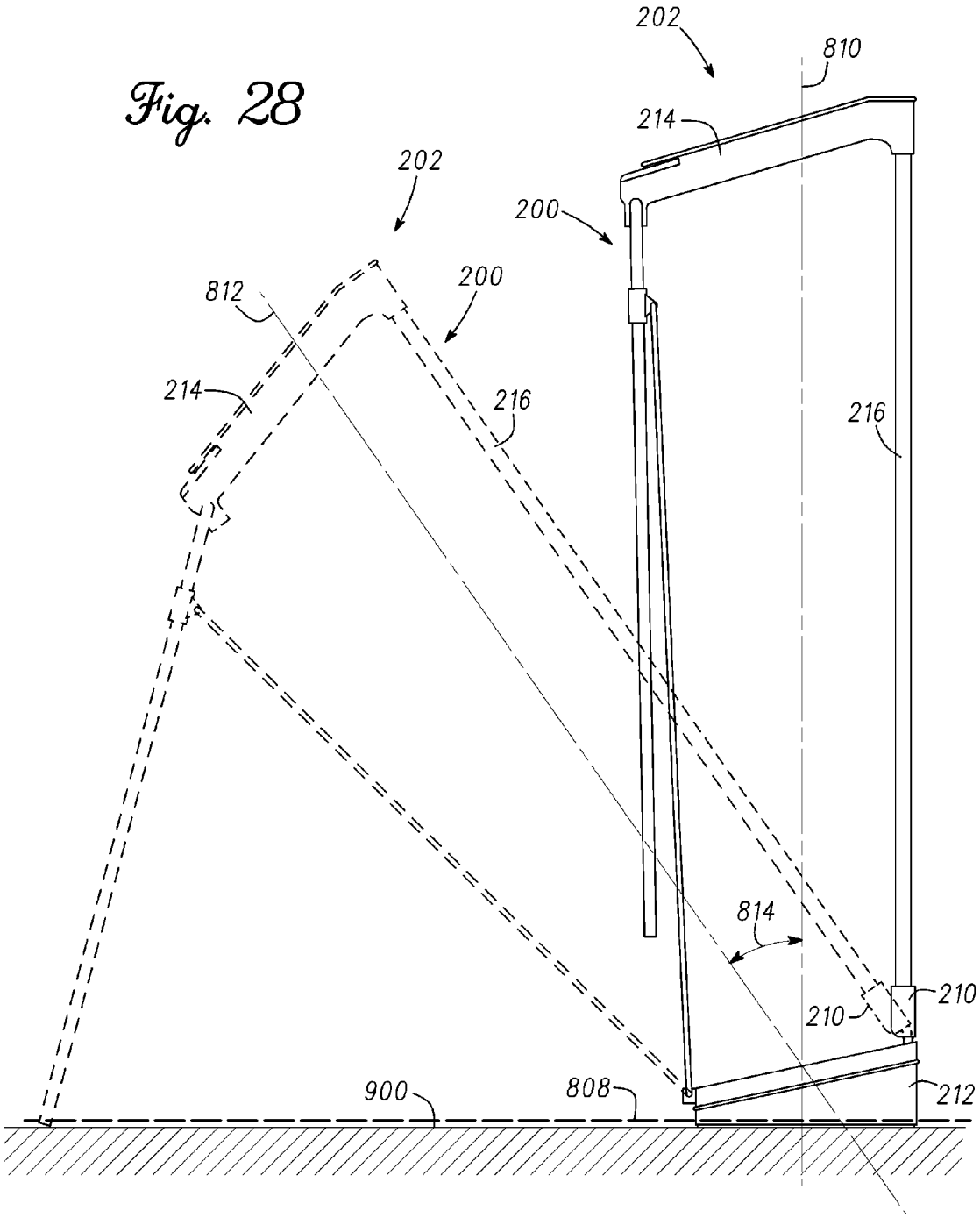
FIG. 28 is a side view sequence of the extensible bag stand of FIG. 17 in a substantially upright position to an angled position shown in phantom.
Figure 29:
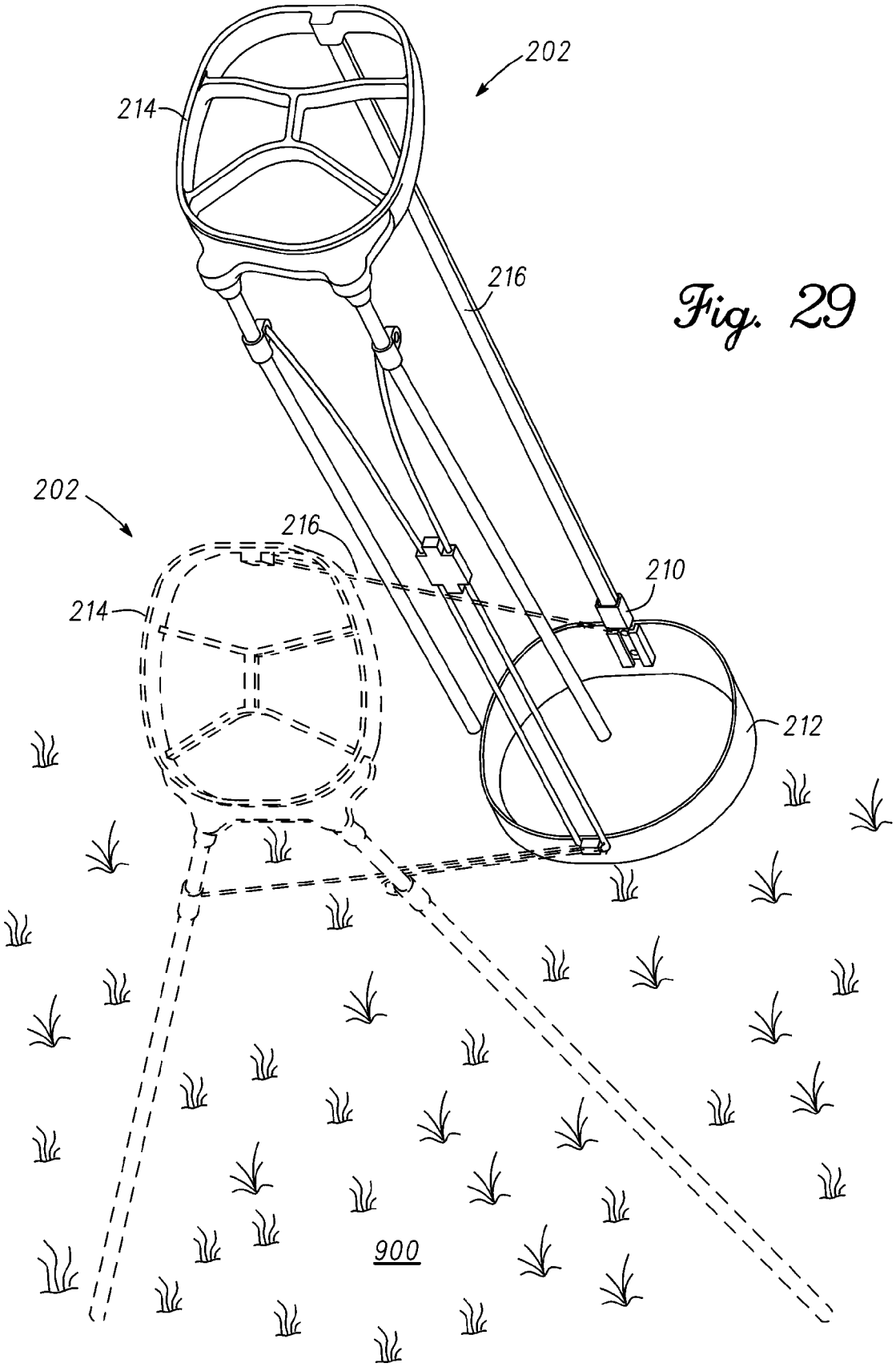
FIG. 29 is a perspective view showing the sequence of the extensible bag stand shown in FIG. 27.

Referring to FIGS. 17-35, a second embodiment of the golf bag, designated 200, is illustrated. In general as shown in FIG. 17, the golf bag 200 includes a body 204 defining an open top end 206 and a closed bottom end 208. As shown, the body 204 includes an extensible bag stand 201 for supporting the body 204 in a substantially angular position when an individual sets down the golf bag 200 on the surface 900 (FIGS. 28 and 29). Referring to FIGS. 17 and 18, the extensible bag stand 201 includes a retraction mechanism 211 having an upper end 247 connected to a plurality of legs 220 and a lower end 248 connected to a toggle switch mechanism 224 for retracting the plurality of legs 220 when the extensible bag stand 201 is placed from the deployed position to the retracted position as shown in FIG. 28. In one embodiment, the plurality of legs may be a first leg 221 and a second leg 222.

Similar to the retraction mechanism 111 for golf bag 100, the extensible bag stand 201 for golf bag 200 may be a spring wire 219 made of a resilient metallic material that bias the plurality of legs 220 outwardly when the body 204 is placed in a deployed position and then retracts the plurality of legs 220 inwardly to the retracted position whenever the body 204 (FIG. 17) is lifted off surface 900 (FIGS. 28 and 29). The spring wire 219 may be a single wire arrangement or a plurality of wires. Alternatively, the spring wire 219 may be made from any other resilient material, such as plastic or metallic composite, capable of repeatedly applying a bias to the plurality of legs 220 in either the deployed position or the retracted position by the extensible bag stand 201.

Figure 19:
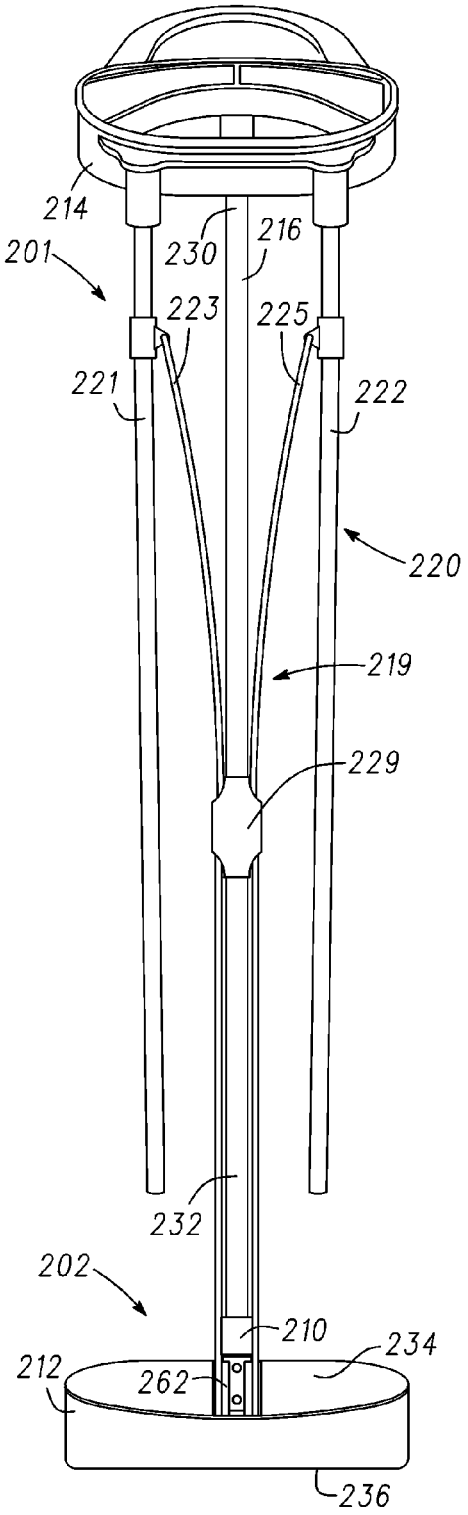
FIG. 19 is a front view of the extensible bag stand with the stabilization and reinforcement system of FIG. 17.
Figure 20:
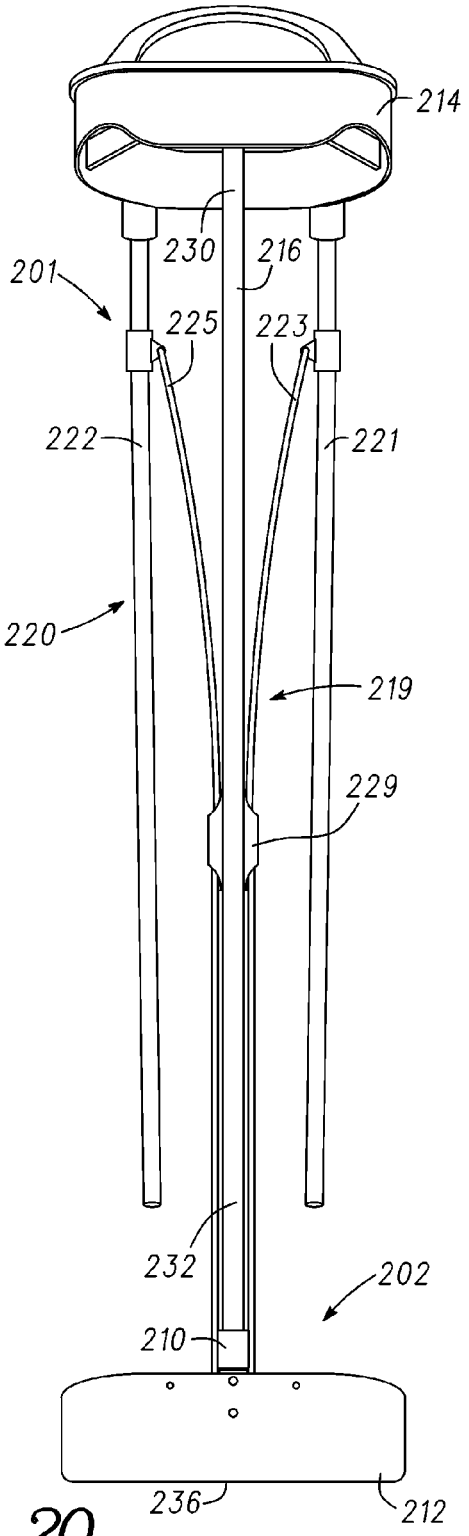
FIG. 20 is a rear view of the extensible bag stand with the stabilization and reinforcement system of FIG. 17.
Figure 21:
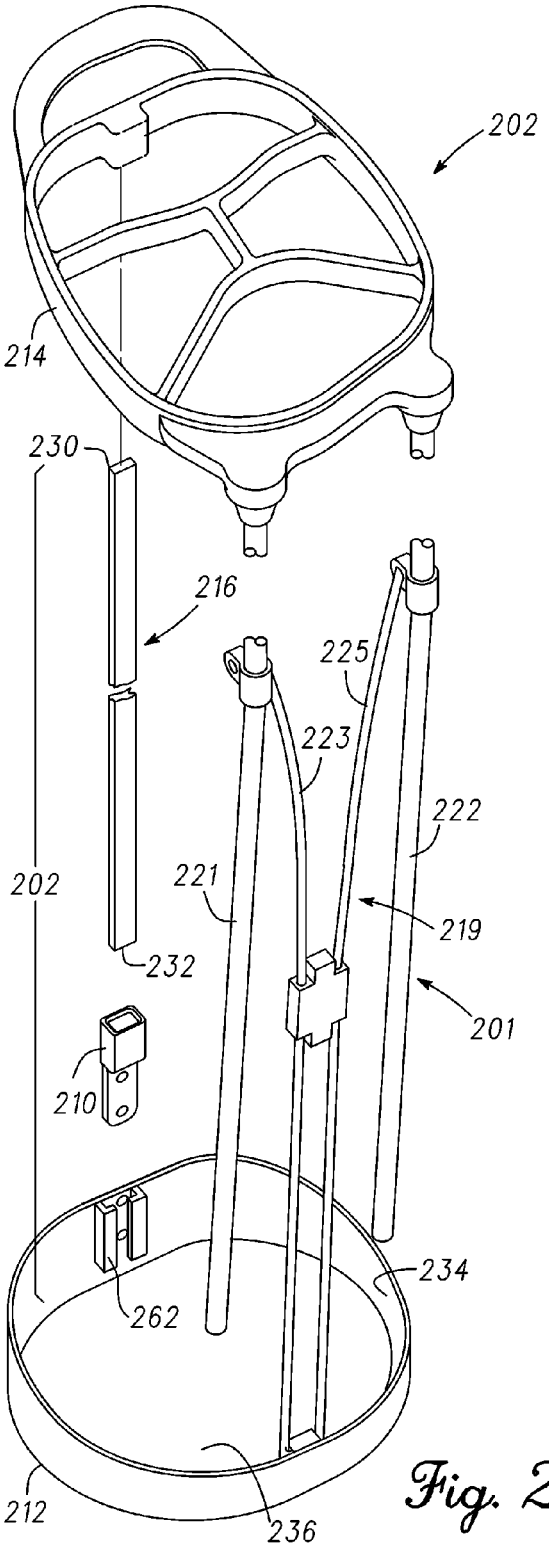
FIG. 21 is an exploded view of the extensible bag stand with the stabilization and reinforcement system of FIG. 17.

As shown specifically in FIGS. 18-20, one example of the spring wire 219 may be first and second wires 223 and 225 that engage the respective pair of legs 221 and 222. Specifically, the upper end 247 of the first and second wires 223 and 225 engage a respective leg 221 and 222, while the lower end 248 of the first and second wires 223 and 225 engage the toggle switch mechanism 224 that forms a part of the extensible bag stand 201 for causing either the deployed position or the retracted position of the plurality of legs 220 by the extensible bag stand 201. In some embodiments, the first and second wires 223 and 225 may be secured together through a coupler 229.

As further shown, the pair of legs 221 and 222 each define a first end 249 configured to support the body 204 in a substantially upright position on the surface 900 (FIGS. 28 and 29) as well as a second end 251 that may be pivotally engaged to a top portion 214 attached proximate or adjacent to the open top end 206 of the golf bag 200. The pivotal engagement of each second end 251 to the top portion 214 may be a pin and socket arrangement which allows movement of the plurality of legs 220 along a two-dimensional plane or a ball and socket arrangement that allows movement of the plurality of legs 220 along a three-dimensional plane. In one embodiment, the structure and operation of the extensible bag stand 201 may be the extensible bag stand disclosed in U.S. Pat. No. 4,834,235, which is incorporated by reference in its entirety. However, the apparatus, articles of manufacture, and methods described herein are not limited in this regard.

Referring to FIGS. 17-21, in one embodiment the extensible bag stand 201 includes a stabilization and reinforcement system 202 that provides a means for reinforcing the structure of the golf bag 200 as well as stabilize the golf bag 200 when the golf bag 200 is placed from a substantially upright position when initially set on the surface 900 (FIGS. 28 and 29) to an angular position when the extensible bag stand 201 places the golf bag 200 in the deployed position. As shown, the stabilization and reinforcement system 202 includes a bottom portion 212 engaged to the top portion 214 of the golf bag 200 through a stay 216. As shown in FIGS. 18-20, the stay 216 defines a first end 230 configured to engage a receptacle 239 formed along a side portion 237 of the top portion 214 to secure the stay 216 therein and a second end 232 configured to engage a flexible one-piece hinge 210 that is engaged to the bottom portion 212 of the golf bag 200 for permitting the stay 216 to pivot when the golf bag 200 is placed in the deployed position. In some embodiments, the first end 230 of the stay 216 may be formed integral with the top portion 214. In some embodiments, the stay 216 may be elongated such that the stay 216 extends substantially the length of the body 204. In addition, the stay 216 may be made from a flexible material that permits the stay 216 to bend or flex under stress.

Referring back to FIG. 18, the top portion 214 forms a divider 231 that is configured to form a plurality of openings 233 for permitting one or more golf clubs (not shown) to be inserted through the open top end 206 of the body 204. The bottom portion 212 includes a side portion 234 that surrounds a lower portion 236. In one arrangement, the toggle switch mechanism 224 is secured to one part of the side portion 234 and the flexible one-piece hinge 210 is secured to an opposing part of the side portion 234 proximate the bottom portion 212. As shown in FIGS. 18, 19, 21, 31 and 32, the side portion 234 of the golf bag 200 includes a slot 262 defining a channel 290 configured to engage the flexible one-piece hinge 210 as shall be discussed in greater detail below. As shown specifically in FIG. 31, in some embodiments the slot 262 includes a first rail 280 and an opposing second rail 282 molded or secured to the side portion 234 of the golf bag 200 to form channel 290.

Referring to FIGS. 22-27, in one embodiment the flexible one-piece hinge 210 includes a hinge body 215 that defines a side surface 209, a front surface 217, and a rear surface 218. In addition, the hinge body 215 defines a receiving portion 226 and an insert portion 228 with a bending portion 235 (FIGS. 22, 23, 26 and 27) formed between the receiving and insert portions 226 and 228. The bending portion 235 is configured to bend and allow the receiving portion 226 to be oriented at an angle relative to the insert portion 228 when the golf bag 200 is placed from a substantially upright position when initially set on the surface 900 to an angular position as the extensible bag stand 201 places the golf bag 200 in the deployed position as shown in FIGS. 28 and 29. In this manner, the receiving portion 226 is bent from the first longitudinal axis 810 wherein the receiving portion 226 is aligned with the insert portion 228 to the second longitudinal axis 812 wherein the receiving portion 226 is not aligned with the insert portion 228.

Figure 31:
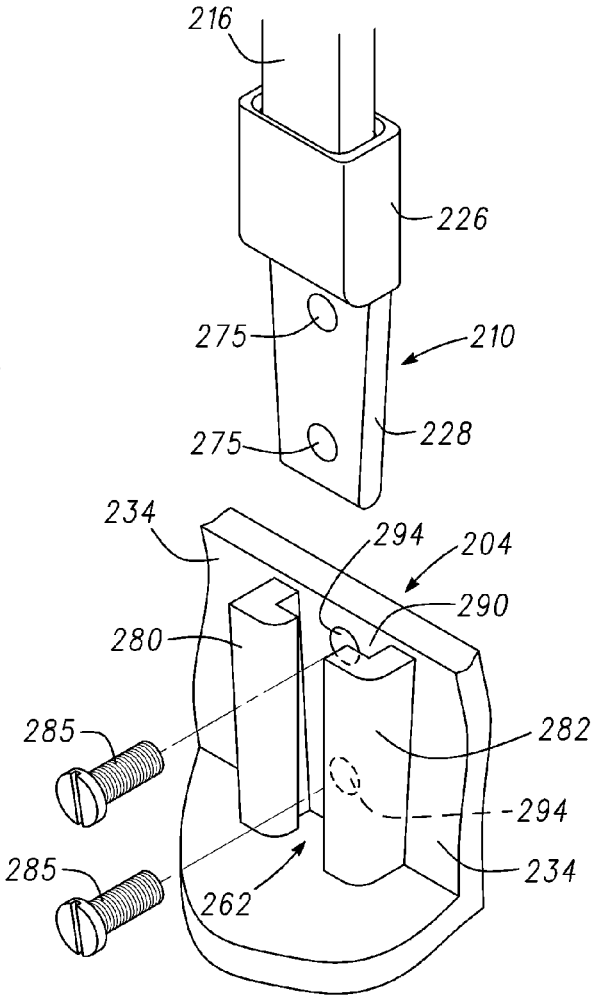

Referring back to FIGS. 22, 23 and 31, in some embodiments the insert portion 228 defines a pair of holes 275 configured to be aligned with a respective pair of holes 294 (FIG. 31) defined by the side portion 234 of the golf bag 200 when engaging the flexible one-piece hinge 210 to the side portion 234. As shown in FIGS. 31 and 32, to engage the flexible one-piece hinge 210 to the body 204, a pair of screws 285 may be inserted through the respectively aligned holes 275 and 294 to secure the insert portion 228 of the flexible one-piece hinge 210 to the side portion 234 of the golf bag 200.

Figure 30:
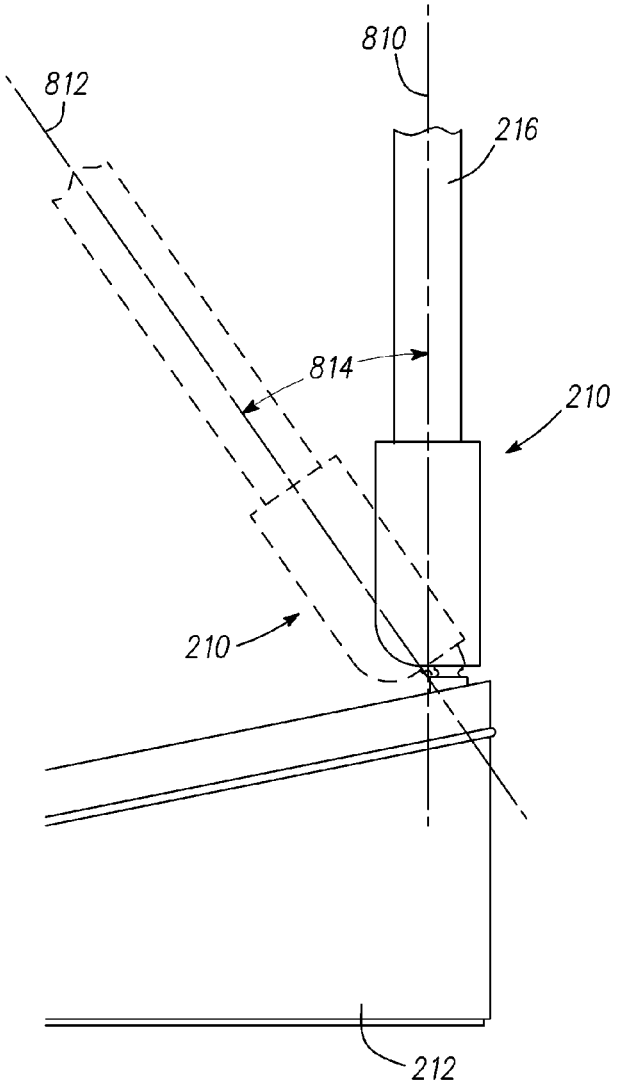
FIGS. 30 and 31 illustrate a sequence for securing the flexible one-piece hinge to the golf bag.

As shown in FIGS. 26, 27, 33 and 34, in some embodiments the bending portion 235 is configured to define an area of reduced thickness 260 in which the thickness of the bending portion 235 is less relative to the thickness of the receiving portion 226 and the thickness of the insert portion 228, respectively. As shown in FIGS. 28 and 30, the area of reduced thickness 260 (FIG. 34) in combination with the inherent flexibility of the material that comprises the flexible one-piece hinge 210, allows the receiving portion 226 to be oriented from a first longitudinal axis 810 to a second longitudinal axis 812 such that an angle 814 is formed between the respective axes 810 and 812 when the flexible one-piece hinge 210 is secured to the side portion 234 of the body 204 as the golf bag 200 is placed in a substantially angular position shown in FIGS. 28 and 29.

In some embodiments as shown in the enlarged view of FIG. 34, the bending portion 235 may also define one or more cut-outs 292 that also reduces the thickness of the bending portion 235 and facilitates the bending of the flexible one-piece hinge 210 along the bending portion 235 as described above. For example, the one or more cut-outs 292 may define at least one of a channel, a recess, hole, a cut-away and/or a cavity. In addition, the one or more cut-outs 292 may be formed along the front surface 217 and/or back surface 218 of the bending portion 235, although the one or more cut-outs 292 may also be formed along the side surface 209 of the bending portion 235. In some embodiments, the cut-outs 292 may be created by removing one or more portions of the hinge body 215 during manufacture along of the bending portion 235. In other embodiments, the flexible one-piece hinge 210 may be molded using a conventional molding process to form the cut-outs 292 rather than removing one or more portions of the hinge body 215 to accomplish the same. The apparatus, systems, methods, and articles of manufacture of the flexible one-piece hinge 210 are not limited in this regard.

Figure 24:
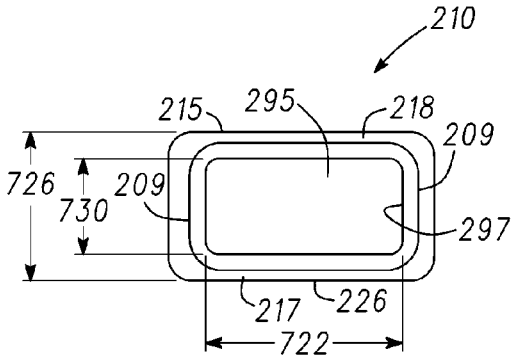
FIG. 24 is a top view of the flexible one-piece hinge of FIG. 22.
Figure 25:
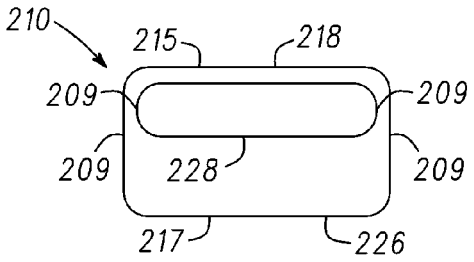
FIG. 25 is a bottom view of the flexible one-piece hinge of FIG. 22.

Referring to FIGS. 24, 26 and 27, the receiving portion 226 of the flexible one-piece hinge 210 defines an opening 297 in communication with a cavity 295. The cavity 295 is configured to receive the second end 232 of the stay 216 therein as shown back in FIG. 18. In some embodiments, the second end 232 may have an adhesive material applied thereto to secure the stay 216 within the receiving portion 226. In some embodiments, the second end 232 may be secured to the receiving portion 226 through a screw or other mechanical attachment means, while in other embodiments the second end 232 of the stay 216 may be freely disposed within the cavity 295. The apparatus, systems, methods, and articles of manufacture of the flexible one-piece hinge 210 are not limited in this regard.

Referring to FIG. 35, a flow chart is shown illustrating a method for manufacturing the golf bag 200 having the extensible bag stand 201 with the stabilization and reinforcement system 202. At block 1100, forming a body 204 comprising a top portion 214 and a bottom portion 212 with the top portion 214 and bottom portion 212 being formed at opposite ends of the body 204. At block 1102, forming a slot 262 defining a channel 290 along the bottom portion 212 of the body 204. At block 1104, forming a flexible one-piece hinge 210 having a hinge body 215 with a bending portion 235 defined between a receiving portion 226 and an insert portion 228, wherein forming the bending portion 235 includes forming an area of reduced thickness 260. At block 1106, securing the insert portion 228 of the flexible one-piece hinge 210 into the slot 262. At block 1108, attaching a first end 230 of a stay 216 to the top portion 214 of the golf bag 200 and attaching a second end 232 of the stay 216 to the receiving portion 226 of the flexible one-piece hinge 210.

While a particular order of actions is illustrated in FIG. 35, these actions may be performed in other temporal sequences. For example, two or more actions depicted in FIG. 35 may be performed sequentially, concurrently, or simultaneously. Alternatively, two or more action depicted may be performed in reverse order. Further one or more actions in FIG. 35 may not be performed at all. The apparatus, methods, and articles of manufacture described herein are not limited in this regard.

In some embodiments, the hinge body 215 may be made from at least one of a flexible material, such as a polyethylene material, a flexible plastic material, and/or an organic or inorganic rubber material, that allows the bending portion 235 to flex or otherwise bend in response to the golf bag 200 being placed in a substantially angular position.

Figure 22:
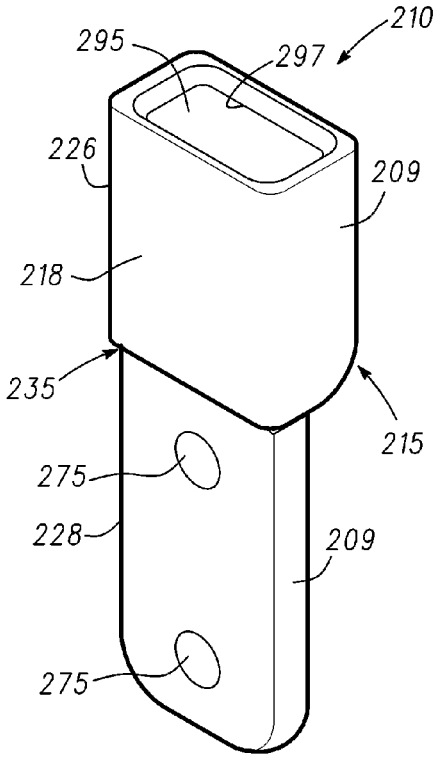
FIG. 22 is a perspective view of a flexible one-piece hinge used in the stabilization and reinforcement system of FIG. 17.
Figure 23:
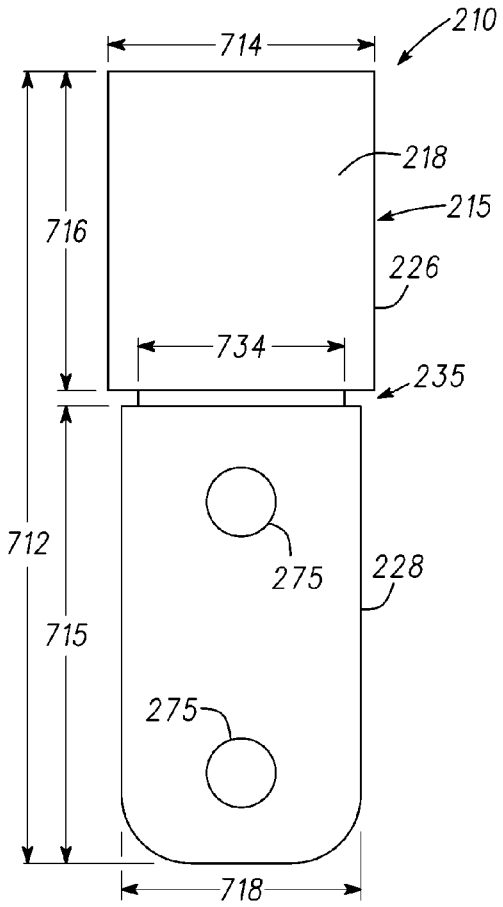
FIG. 23 is front view of the flexible one-piece hinge of FIG. 22.

In some embodiments, the flexible one-piece hinge 210 may have the following dimensions as shown in FIGS. 22, 24 and 34. The receiving portion 226 of the flexible one-piece hinge 210 may have a width 714 of 2.00 cm, a length 716 of 2.50 cm, and a thickness 726 of 1.00 cm, while the insert portion 228 may have a length 715 of 3.5 cm, a width 718 of 1.80 cm, and a thickness 724 of 0.35 cm. In addition, the opening 297 of the receiving portion 226 may have a length 722 of 1.60 cm and a width 730 of 0.60 cm. The bending portion 235 of the flexible one-piece hinge 210 may have a length 732 of 0.25 cm, a width 734 of 1.60 cm, and a thickness 728 of 1.40 cm. Finally, the flexible one-piece hinge 210 may have an overall length 712 of 6.25 cm.

While the figures may depict a top portion of a golf bag with a particular number of dividers and openings to receive one or more golf clubs, the apparatus, methods, and articles of manufacture described herein may include a top portion with more or less dividers or openings to receive golf clubs (e.g., a three-way top, a five-way top, a six-way top, a fourteen-way top, etc.). Although the figures may depict an extensible bag stand with a particular number of deployable legs, the apparatus, systems, methods, and articles of manufacture described herein may include an extensible bag stand with more or less deployable legs.

Further, while the figures may depict a particular type of bottom portion of a golf bag (e.g., the height of the bottom portion decreases in a linear manner from one end to the opposite end), the apparatus, systems, methods, and articles of manufacture may be applicable to other type of bottom portions (e.g., the height of the bottom portion decreases in a non-linear manner (e.g., lock step). Although the above examples may be describe and the figures may depict a carry golf bag, the apparatus, systems, methods, and articles of manufacture described herein may be applicable to cart golf bags, travel bags for golf bags, or other suitable type of bags (e.g., luggage, etc.). Alternatively, the apparatus, systems, methods, and articles of manufacture described herein may be applicable to tripods for cameras, camcorders, and/or other electronic devices.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A bag comprising:

a body with a top portion at one end of the body and a bottom portion at an opposite end of the body, the bottom portion defines a bottom side portion of the body;

a stay having a first end and a second end, the first end of the stay is engaged to the top portion of the body;

a slot formed along the bottom side portion of the body; and a flexible one-piece hinge engaged to the slot, the flexible one-piece hinge comprising:

an insert portion;

a receiving portion formed opposite the insert portion, wherein the receiving portion forms an opening in communication with a cavity configured to receive the second end of the stay, and a bending portion formed between the insert portion and the receiving portion for orienting the receiving portion at an angle relative to the insert portion, wherein the flexible one-piece hinge is a unitary construction, and wherein the insert portion is engaged to the slot and the receiving portion receives the second end of the stay into the cavity in the receiving portion.

2. The bag of claim 1, wherein the slot comprises a first rail and a second rail molded to the inside of the bottom side portion of the body that collectively form a channel configured to slidably receive the insert portion therein.

3. The bag of claim 1, wherein the bending portion defines an area of reduced thickness having a first thickness that is greater than a second thickness defined by the receiving portion or a third thickness defined by the insert portion.

4. The bag of claim 1, wherein the insert portion defines at least one hole configured to receive a respective securing member for securing the insert portion to a side portion of the body.

5. The bag of claim 1, wherein the stay is disposed substantially longitudinally along the bag.

6. The bag of claim 1, wherein the flexible one-piece hinge comprises at least one of a polyethylene material, a flexible plastic material, or an organic or inorganic rubber material.

7. The bag of claim 1, wherein the bending portion is configured to bend and orient the receiving portion from a first axis in which the receiving portion is aligned with the insert portion to a second axis in which the receiving portion is not aligned with the insert portion.

* * * * *